US005646598A

United States Patent [19]

Nickles et al.

[11] Patent Number: 5,646,598

[45] Date of Patent: Jul. 8, 1997

[54] SMOKE DETECTOR WITH ADVANCED SAFETY FEATURES

[76] Inventors: Aaron Michael Nickles, 154 Columbus Ave. #2N, New York, N.Y. 10023; Daniel Robert Nickles, 11 Cheyenneue Rd., Lafayette, N.J. 07848; Al Saferstein, 748 Virginia Dare Dr., Virginia Beach, Va. 23451

[21] Appl. No.: 432,831

[22] Filed: May 2, 1995

[51] Int. Cl.[6] ..... G08B 17/10

[52] U.S. Cl. ..... 340/628; 340/636; 340/691; 340/693

[58] Field of Search ..... 340/628, 693, 340/636, 691; 320/48; 116/315

[56] References Cited

U.S. PATENT DOCUMENTS

| | | | |
|---|---|---|---|
| 3,846,773 | 11/1974 | Lintelmann et al. | 340/237.5 |
| 4,195,286 | 3/1980 | Galvin | 340/501 |
| 4,228,428 | 10/1980 | Niedermeyer | 340/693 |
| 4,313,110 | 1/1982 | Subulak et al. | 340/527 |
| 4,388,617 | 6/1983 | Nakanishi et al. | 340/636 |
| 4,567,477 | 1/1986 | Cormier | 340/644 |
| 4,600,314 | 7/1986 | Theriault | 368/10 |
| 4,814,748 | 3/1989 | Todd | 340/628 |
| 4,827,244 | 5/1989 | Bellavia et al. | 340/628 |
| 4,881,063 | 11/1989 | Fawcett | 340/691 |
| 4,959,640 | 9/1990 | Hall | 340/693 |
| 4,975,688 | 12/1990 | Gonzales | 340/693 |
| 5,053,752 | 10/1991 | Epstein et al. | 340/636 |
| 5,055,830 | 10/1991 | Cousins et al. | 340/693 |
| 5,093,651 | 3/1992 | Thomas | 340/628 |
| 5,105,371 | 4/1992 | Shaw et al. | 364/550 |
| 5,107,446 | 4/1992 | Shaw et al. | 364/550 |
| 5,191,855 | 3/1993 | Conforti | 340/636 |
| 5,289,165 | 2/1994 | Belin | 340/693 |

*Primary Examiner*—Jeffery Hofsass
*Assistant Examiner*—Daniel J. Wu

[57] ABSTRACT

A smoke detector that provides a battery warning arm that is pivotally attached to the smoke detector and is normally stored in a flush position within the smoke detectors cover. Upon the detection of a battery that is low, dead, missing, or not correctly aligned with its electrical contacts, the warning arm is released by a latch and swung down from the detector to display a luminous brightly colored instructional warning. When the warning arm is activated due to a low battery, the arm swings down and continues to swing in a pendulum manner to attract further attention. Even when the smoke detector's battery ceases to provide any electrical energy, the warning arm continues to warn persistently and cannot be repositioned to its stowed position until the detector has ample battery power. When deployed the warning arm exposes the battery and also a spare battery compartment whereby the warning arm also serves as a battery door.

10 Claims, 11 Drawing Sheets

FIG. 18
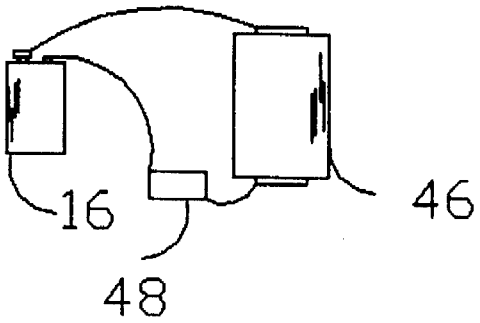
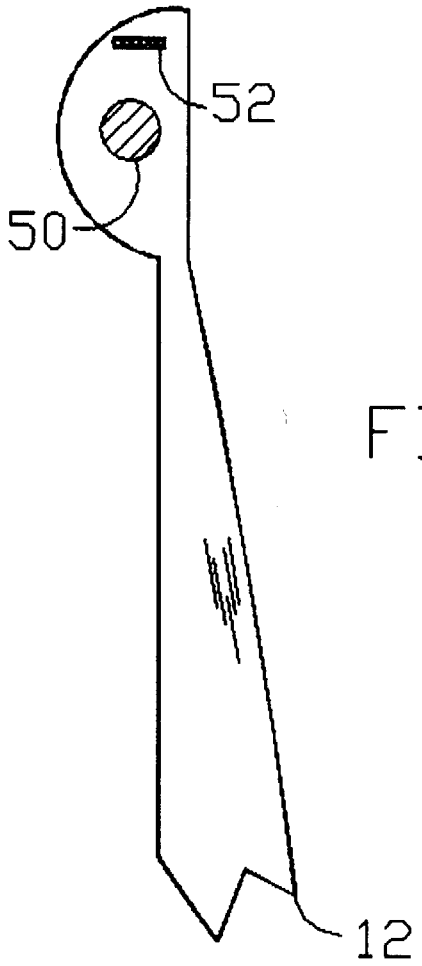
FIG. 19

SMOKE DETECTOR WITH ADVANCED SAFETY FEATURES

BACKGROUND—DESCRIPTION OF PRIOR ART

Statistics indicate that three-fourths of American homes have at least one smoke detector. However, the NFPA (National Fire Protection Agency) estimates that one-third of those detectors do not work, often because of dead or missing batteries. If this trend continues, the NFPA predicts that up to one-half of all smoke detectors will be non-operational within 10 years. Industry is aware of the problems associated with smoke detectors and has responded with several safety features that are effective but not flawless as evidenced in the above statistics. This invention addresses specific problems associated with smoke detectors on the market today and offers solutions, in the form of certain innovations that will save many lives.

Modern smoke detectors warn a person when a smoke detector's battery is low by producing a chirping sound once a minute. This chirp continues for approximately a month—when the battery goes dead—or until someone either replaces or removes the battery. In a study conducted by the Dallas Texas Fire Department, people described the low battery indicator as annoying. They removed the battery in order to silence the disruptive chirping and then did not replace it (William Jernigan, Ph.D "Keeping the Smoke Detectors Operational: The Dallas Experience", *Fire Journal,* July/August 1987, pp 57–63). This has resulted in many deaths. For example, on Nov. 29, 1984, a four-year-old boy was killed when residents removed the smoke detector because it was chirping (William Jernigan, Ph.D "Keeping the Smoke Detectors Operational: The Dallas Experience", *Fire Journal,* July/August 1987, pp 57–63).

Besides being annoying, other problems exist with the low battery chirping warning. Many elderly or hearing impaired cannot hear the chirping warning and do not know when their batteries need to be replaced. The chirping sound continues until the battery is completely depleted which occurs in about a month. New tenants or vacationers returning after a month away cannot possibly know that a battery is dead since chirping cannot occur without battery power.

Dead batteries probably reflect a lack of regular testing and maintenance, and the problem may be compounded by some individual's unfamiliarity with the meaning of the sounds and signals now used to indicate low battery power (John R. Hall, Jr. "The Latest Statistics on US Home Smoke Detectors" *Fire Journal,* January/February 1989, pp 39–41). When the low battery warning beep occurs in a conventional smoke detector, a person who has not read the instructions may assume the detector is defective and remove it. Most people are not able to tell if a battery in a conventional smoke detector is low or missing unless they read the directions thoroughly. Often people do not read instructions when installing or using any new product, especially complicated smoke detector instructions.

Smoke detectors batteries are removed when low battery chirping begins and when false alarm conditions occur. Many people also remove batteries from smoke detectors in order to use them in other electronic devices, such as television remote controls and electronic toys. Many people have died because their smoke detectors lacked batteries. A fire claimed the lives of two children and a woman when the smoke detectors in the basement and on the second floor did not operate because they lacked batteries ("Fire Watch—Residential" *NFPA Journal* September/October 1993 page 36).

Smoke detectors on the market today are supposed to prevent the consumer from closing the battery compartment if there is no battery, but the design is flawed.

A prevalent smoke detector on the market today includes a hinged cover that is attached to the detector's base plate in which the base plate houses the battery and electrical components. The hinged cover is designed so that it can not be closed unless a battery is present. However, the hinged cover can easily be forced into position when no battery is present. Furthermore, when the hinged cover is not in the closed position, there is no visual warning indicating a missing battery, just exposed electronic circuitry. Again, a person may assume the detector to be faulty and remove it completely.

Another smoke detector design includes a battery drawer that slides in and out from the smoke detector in a horizontal motion. The compartment drawer can not be reposition into the smoke detector unless the a battery is present. The door, however, is slightly bigger than the battery and therefore offers no effective visual warning that the battery is missing. Also, there is no warning label present on the drawer.

For smoke detectors in which the battery is mounted in an outside compartment, the safety feature prevents the smoke detector from being mounted at all when there is no battery. Most people will not notice that their smoke detector is missing from the ceiling or wall and will probably not replace the battery.

Another common problem that occurs is misalignment of the battery with the smoke detector's electrical contacts. Misalignment occurs when people do not properly install their battery or when they remove the battery from the smoke detectors contacts in order to silence the low battery chirping or a false alarm.

If a smoke detector's battery has been repositioned so that the battery terminals are not in contact with the battery, the hinged cover or battery compartment can still be closed since the battery is actually present. In the case of the external battery compartment, the detector can still be mounted since the battery is in the compartment.

Thus, the two conventional warning features discussed are not effective when a battery is off its electrical contacts. Manufacturers that sell smoke detectors with a battery included store the battery in the battery compartment, however it is not connected to the smoke detector's battery contacts. Consequently when a person unpacks the smoke detector, he or she will not know that the battery is not connected unless the cover or the battery compartment is removed. This further illustrates the unfriendliness of smoke detectors on the market today.

As stated, chirping cannot occur when a battery is not connected or misaligned with its electrical contacts since there is no battery power. On Nov. 13, 1993, five deaths occurred (three of them under the age of 6) when a smoke detector did not work because, as officials stated, the battery was slightly out of alignment with the contacts (Kenneth J. Tremblay "Catastrophic Fires and Deaths Drop in 1992" *NFPA Journal* September/October 1993 pp 56–69). No known smoke detector has the ability to warn if a battery is not properly aligned with its electrical contacts.

Various means have been employed to address the low battery warning problems of a battery operated smoke detector. In U.S. Pat. No. 5,053,752 to Epstein issued Oct. 1, 1991, the invention warns if a battery is low by displaying a elongated flexible signal member that would hang down from the smoke detector at eye level. Although this invention warns someone that a battery is low by a visual warning, it does so in a manner that is unpractical. After the member is displayed, a person can easily pull the member, like a string on an overhead light, and remove it from the detector permanently. A person would be inclined to do so since the flexible member is hanging at eye level and possibly obstructing his or her path. Thus, this invention is prone to easy tampering. Tampering of smoke detectors is common (removing good batteries, misaligning the smoke detector's battery with its electrical contacts, forcing the smoke detector's cover to close when no battery is present, etc.). Children would find it easy and amusing to yank on the flexible member to remove it permanently. Moreover, even if a person does replace the battery in the smoke detector, restoring the elongated flexible member would prove to be difficult due to the design of the elongated members housing. To restore the elongated member, a person would have to carefully reel or push the member into the housing. This is inconvenient and encourages the detachment of the elongated flexible member from the housing.

OBJECTS AND ADVANTAGES

Accordingly the following objects and advantages of this invention are as follows:

(a) to provide a complete yet simple solution to the many problems inherent to battery powered smoke detectors as indicated in the problems set forth above.

(b) to provide a new and improved apparatus and method for warning of any battery condition in devices, such as smoke detectors and carbon monoxide detectors.

(c) to provide such apparatus and method which gives a visible battery warning display when a battery is missing, depleted, or if the battery is misaligned with the electrical contacts of the device.

(d) to provide such apparatus and method which is so prominent, yet non-intrusive, that it is extremely difficult or virtually impossible to ignore.

(e) to provide such apparatus and method wherein the battery warning display is given even after the battery in question has expired and any audible warning ceases.

(f) to provide such apparatus and method that is not susceptible to easy tampering and is practical to use.

(g) to provide such apparatus and method wherein the low battery warning display moves in a pendulum manner—much like the pendulum of a grandfathers clock—to attract further attention to a low battery condition.

(h) to provide such apparatus and method wherein the battery warning displays a bright colorful, luminescent warning label when a battery is missing, depleted, or even if the battery is off its electrical contacts. This display provides a visual and instructional warning to replace or realign a battery thus making it extremely simple to operate and requiring no prior knowledge of operation. The warning label also stands out in low light conditions due its luminescence.

(i) to provide such apparatus and method wherein the battery warning display can not be repositioned until sufficient power is supplied to the device.

(j) to provide such apparatus wherein the battery warning display is integrated into the device so that it serves also as a battery door.

(k) to provide such apparatus wherein the devices cover conceals and protects the devices circuitry.

(l) to provide such apparatus wherein the battery warning display, when activated, exposes the devices battery thus making the battery easy to replace and provides additional visual indication of the critical battery condition by exposing the battery.

(m) to provide such apparatus wherein the device provides a receptacle for a spare battery. This spare battery compartment is adjacent to the main battery compartment and thus is exposed when the battery warning display is activated.

BRIEF DESCRIPTION OF THE DRAWINGS

FIGS. 18 and 19 illustrate a schematic diagram of the battery warning arm illustrating the components of a circuit for the operation of the pendulum-like nature of the arm.

Reference Numerals

| | | | |
|---|---|---|---|
| 10 | smoke detector | 60 | persons hand |
| 12 | battery warning arm | 62 | latch |
| 14 | conventional 9 volt dry cell spare battery | 64 | coil spring |
| | | 66 | 9 volt battery source |
| | | 68A–B | relays |
| 16 | conventional 9 volt dry cell battery | 70A–B | capacitors |
| | | 72A–B | contact switches |
| 18A–D | battery mounting brackets | 74 | high voltage detection circuit |
| 20 | ventilated slots | 76 | low voltage detection circuit |
| 22 | luminous warning label | 78 | contact arm |
| 24 | spare battery label | 80 | spring band |
| 26 | bottom base plate | 82 | operating circuit |
| 28 | spacers | 84 | double pole single solenoid |
| 30A–B | mounting slots | | |
| 32 | cover | 112A–C | clips |
| 38 | detector operating board | 116A–B | battery contacts |
| | | 118 | pin assembly |
| 40A–B | spaced mounting clips | 126A–126B | Battery wires |
| 42A–B | lead wires | | |
| 44 | solenoid assembly | | |
| 46 | electromagnet | | |
| 48 | switch | | |
| 50 | pin | | |
| 52 | permanent magnet | | |
| 54 | warning arm latch | | |
| 56A–B | mounting holes | | |

PREFERRED EMBODIMENT—DESCRIPTION

Figure 1:
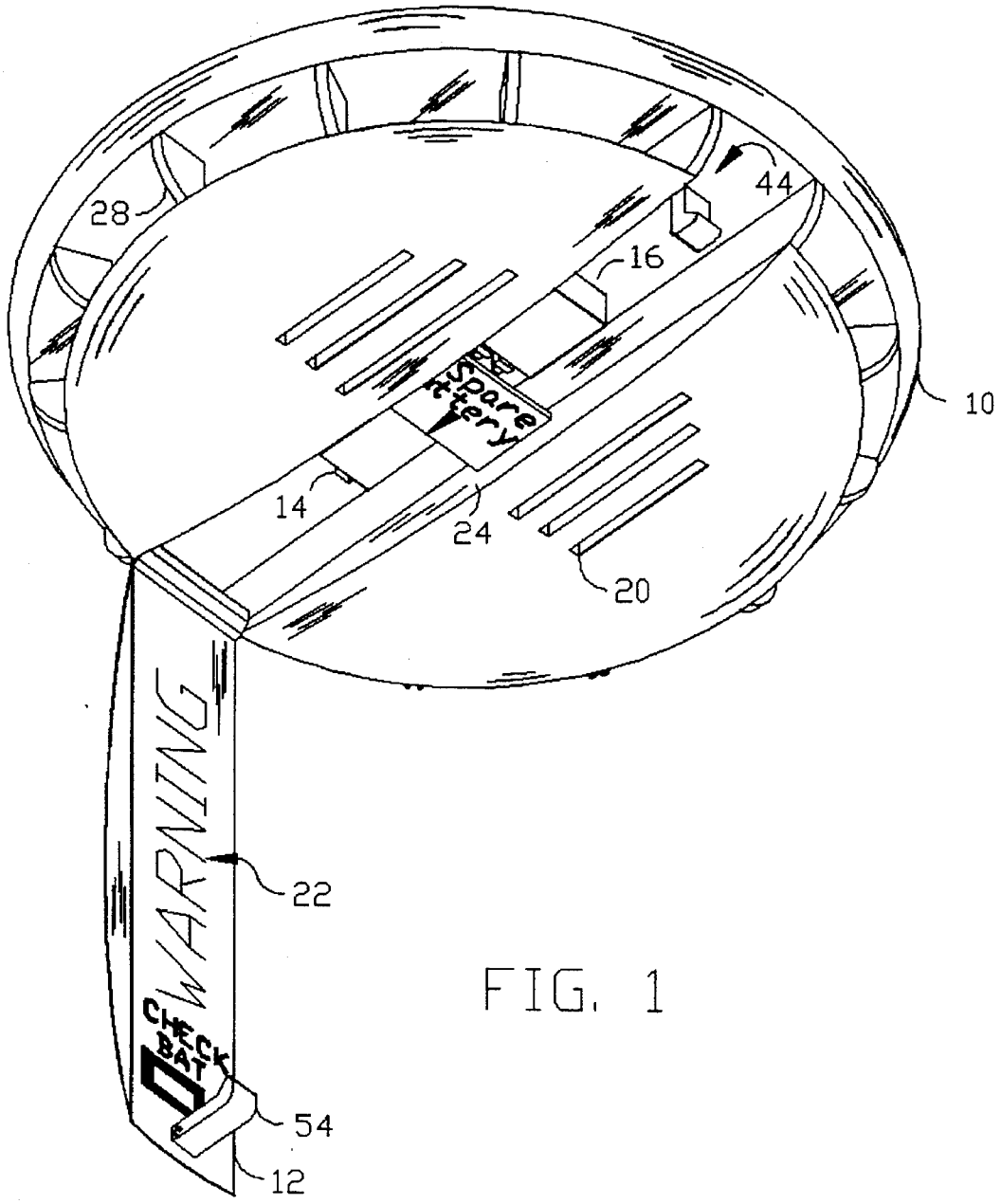
FIG. 1 is a perspective view of the smoke detector.
Figure 2:
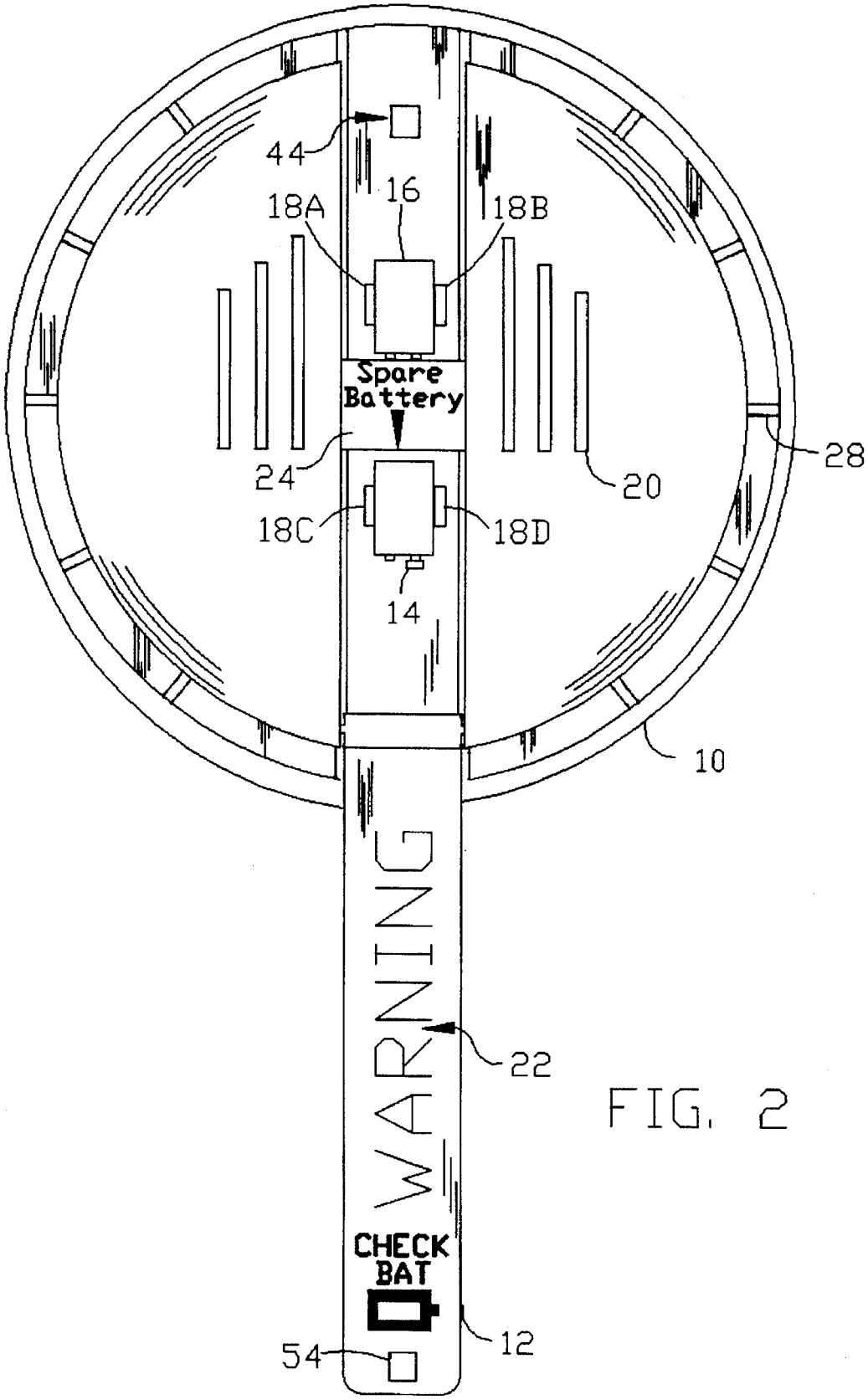
FIG. 2 is a front plain view of the smoke detector.

FIGS. 1 and 2 of the application drawings show a smoke detector 10 constructed in accordance with the invention.

Referring to FIGS. 1 and 2, detector 10 includes a battery warning arm 12 with warning label 22 consisting of luminous brightly colored instructional graphics and words, conventional 9 volt dry cell spare battery 14 with battery mounting brackets 18C and 18D, spare battery label 24, conventional 9 volt dry cell battery 16 with battery mounting brackets 18A and 18B, and ventilated slots 20 to serve as passage way for any smoke or alarm sound.

Figure 3:
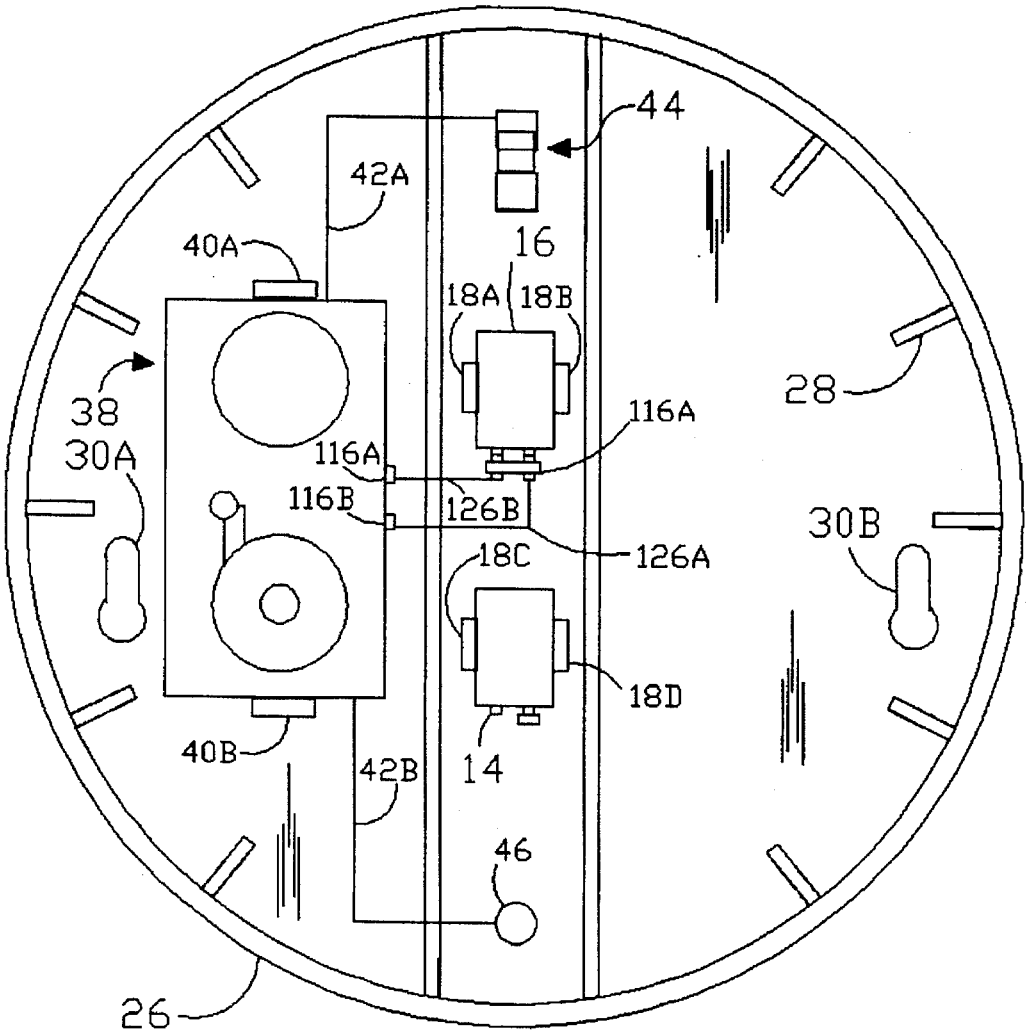
FIG. 3 is a bottom plain view of the smoke detector of FIG. 1 with the cover removed to clearly illustrate the working components of the smoke detector.

FIG. 3 which is a bottom plain view of the smoke detector of FIG. 1 illustrates further components of the smoke detector. The bottom base plate 26 is shown with formed therein spacers 28 to separate cover 32 of FIG. 4. Referring to FIG. 3, spaced mounting slots 30A and 30B formed therein are used for wall or ceiling mounting of the smoke detector through the use of conventional mounting screws. Cover 32 of FIG. 4 is mounted to bottom base plate 26 at spacers 32 of FIG. 3 by glue or plastic welding.

As seen in FIG. 3 detector operating board 38 is mounted to bottom base plate 26 by spaced mounting clips 40A and 40B. Connected to detector operating board 38 are two lead wires 42A and 42B that connect solenoid assembly 44 and electromagnet 46. Battery 16 is connected by battery mounting brackets 18A and 18B and supplies energy to detector operating board 38 by battery wires 126A and 126B which lead to battery contacts 116A and 116B.

Figure 4:
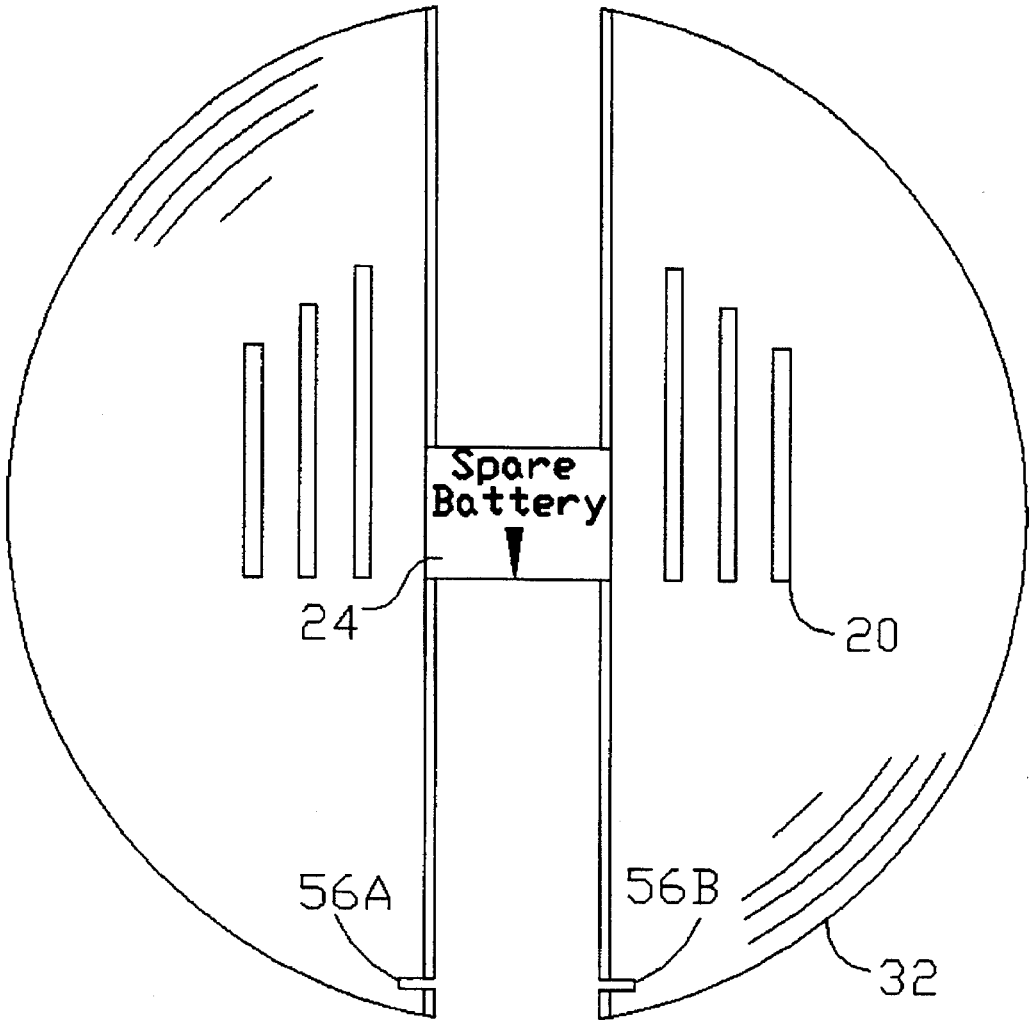
FIG. 4 is a top plain view of the removed cover of FIG. 1.
Figure 5:
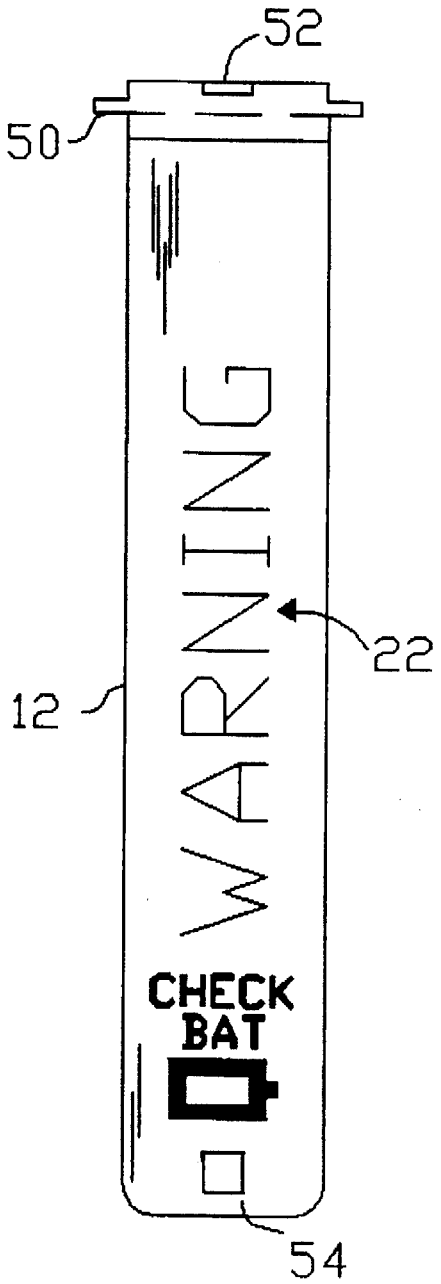
FIG. 5 is a top plain view of the removed battery warning arm of FIG. 1.

FIG. 5 illustrates battery warning arm 12, warning label 22, pin 50, permanent magnet 52, and warning arm latch 54. Battery warning arm 12 is mounted to cover 32 of FIG. 4 by pin 50 and mounting holes 56A and 56B.

The components of FIGS. 3, 4, and 5 are assembled to form the preferred embodiment of FIG. 2.

FIGS. 6–13 illustrates various positions of battery warning arm 12 of smoke detector 10 when it is automatically activated.

Figure 14:
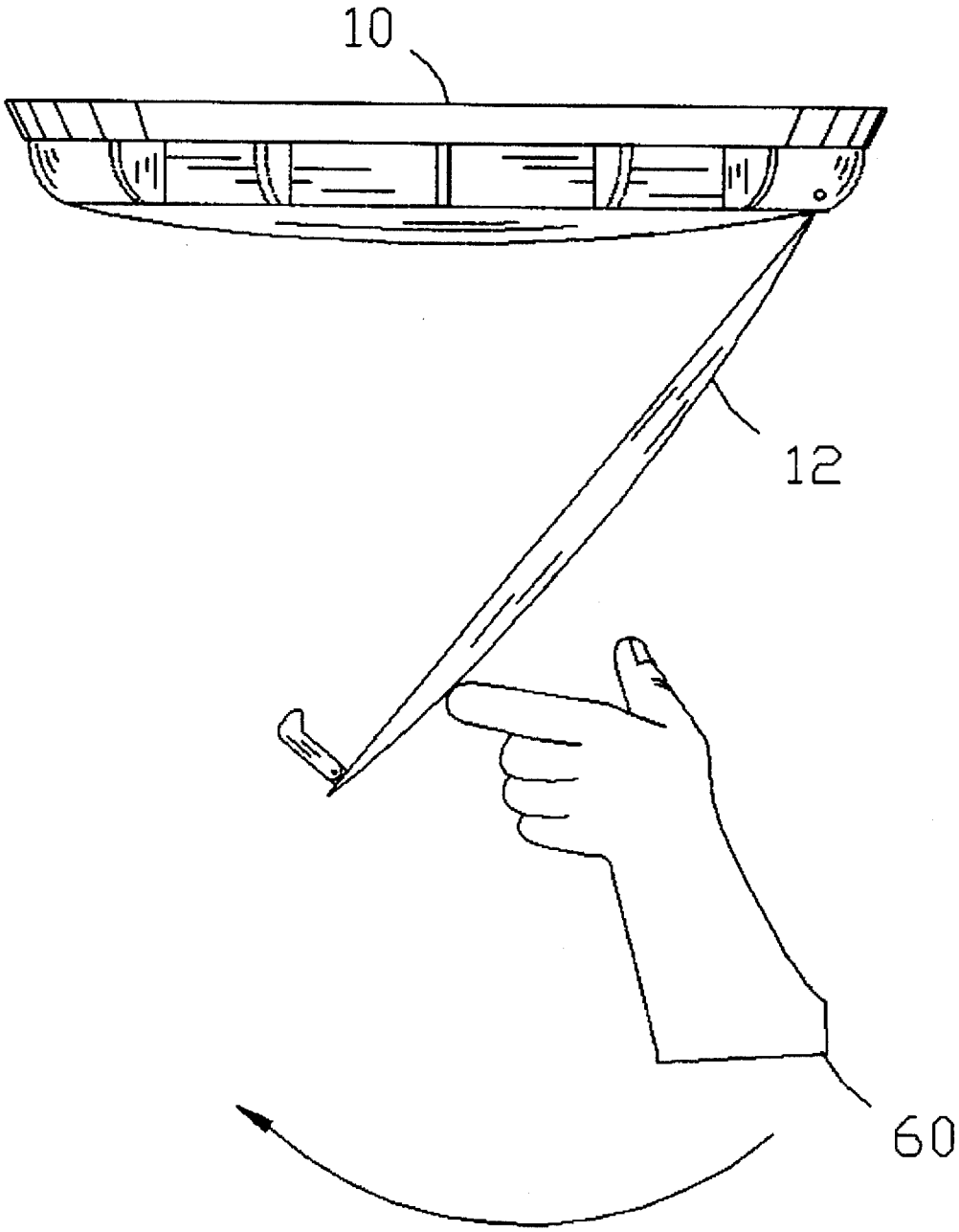
FIG. 14 is a side view of the smoke detector of FIG. 1 showing a persons hand resetting the battery warning arm.

FIG. 14 shows a persons hand 60 resetting the battery warning arm 12 of smoke detector 10.

Figure 15:
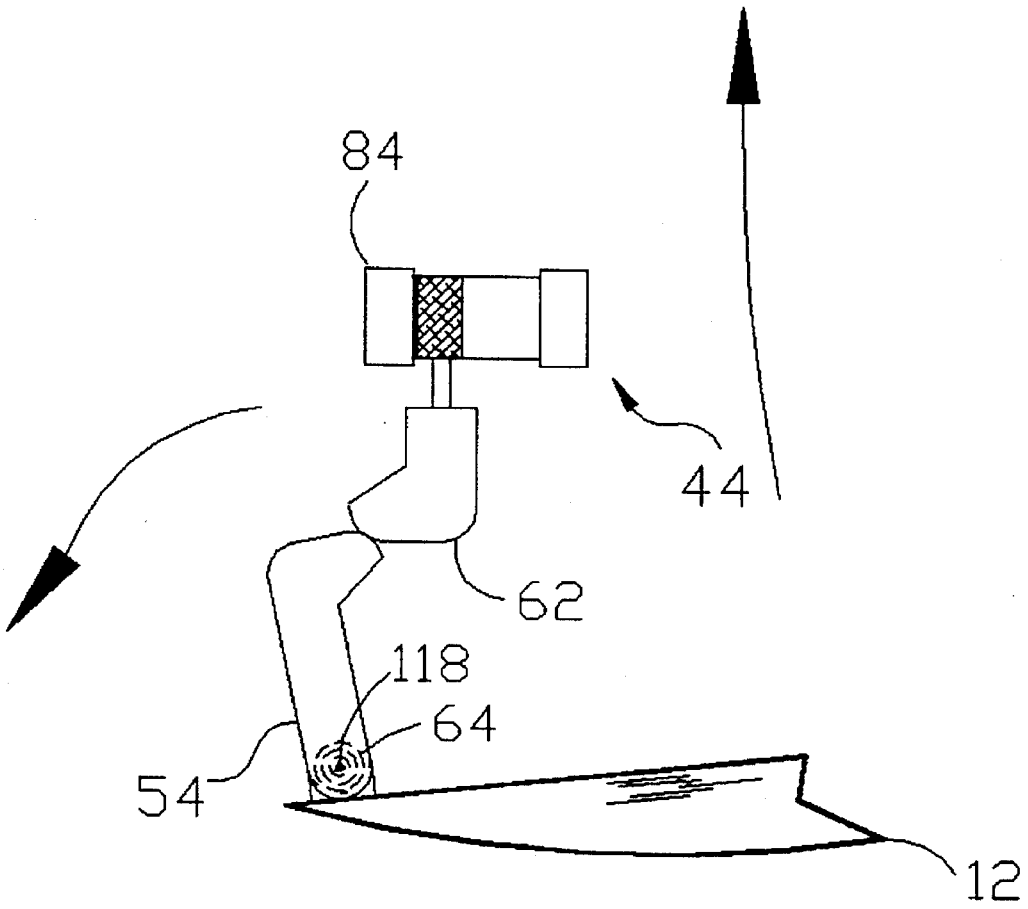
FIG. 15 is a partly cross-sectional, partly schematic and broken-away side view of the latching operation during replacement of the battery warning arm.

FIG. 15 illustrates the mechanics of replacing battery warning arm 12. Solenoid assembly 44 consisting of latch 62 is married to warning arm latch 54 that is connected to battery warning arm 12 by pin assembly 118 and spring loaded by coil spring 64.

Figure 16:
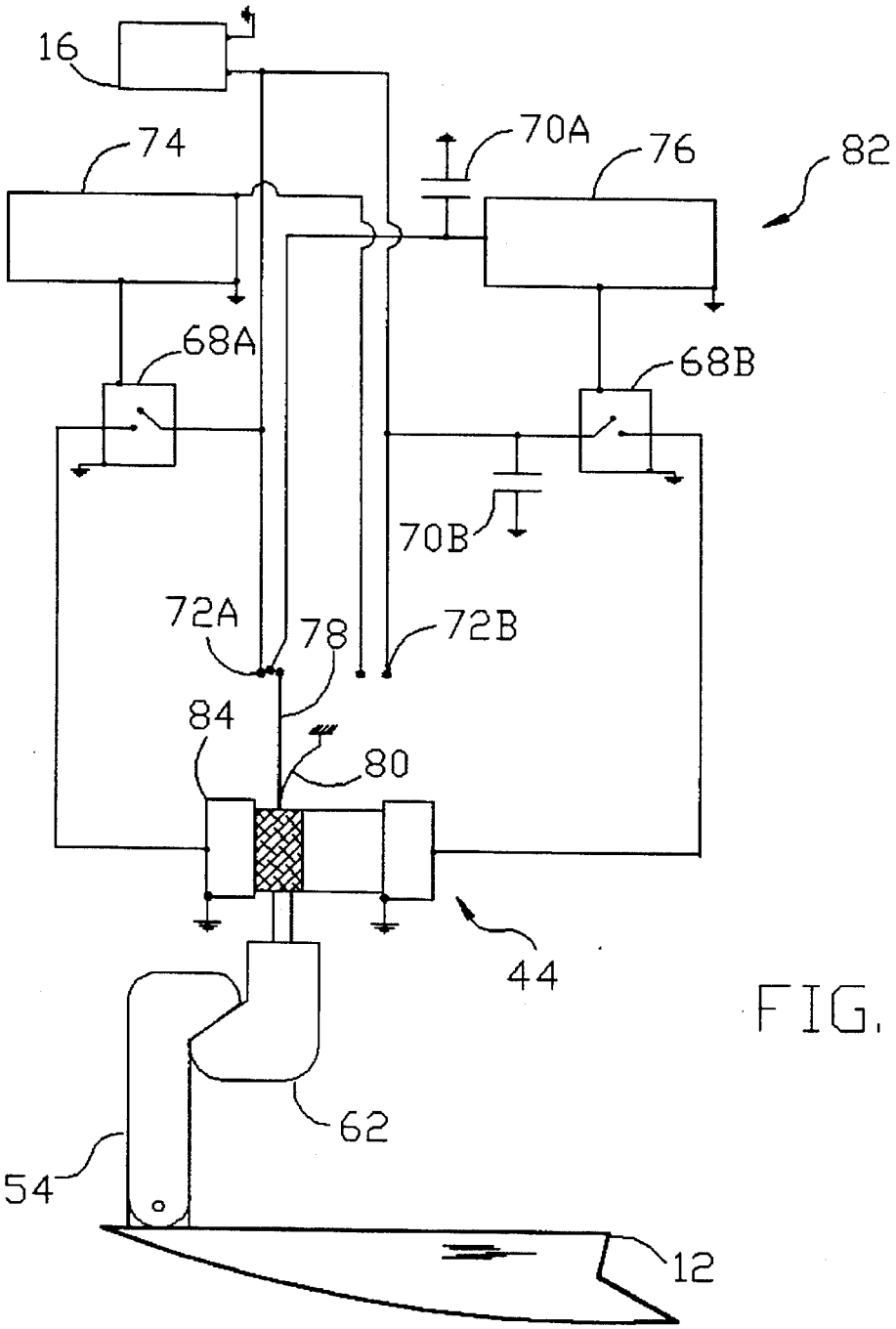
FIG. 16 is a schematic diagram of an operating circuit in which the position of the solenoid's latch holds the warning arm in its stowed position.

FIG. 16 is a schematic diagram of operating circuit 82 in which the position of the solenoid's latch holds warning arm 12 in its stowed position. Circuit 82 is integrated into the detector operation board 38 of FIG. 3. Circuit 82 consists of 9 volt battery source 16, two relays 68A and 68B, two capacitors 70A and 70B, two contact switches 72A and 72B, a high voltage detection circuit 74, a low voltage detection circuit 76, and solenoid assembly 44 which consists of double pole single solenoid 84, contact arm 78, spring band 80, and latch 62. FIG. 16 also shows warning arm latch 54.

Figure 17:
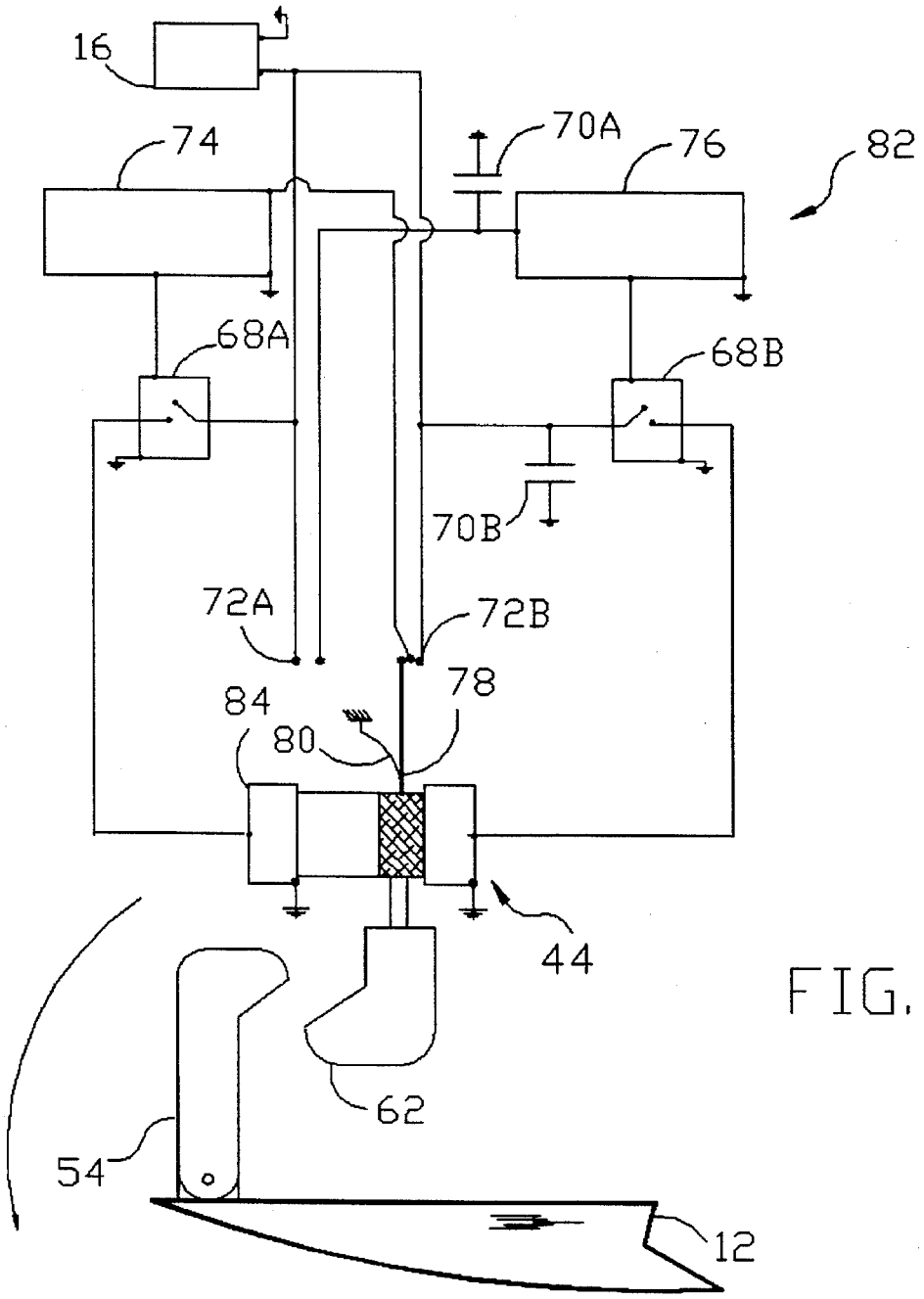
FIG. 17 is a view like FIG. 16 which the position of the solenoid's latch releases the warning arm forcing it to swing down from the detector.

FIG. 17 is a view like FIG. 16 except that the position of latch 62 releases warning arm 12 so that it swings down from the detector by the force of gravity. The position of latch 62 also activates high voltage detection circuit 74.

FIGS. 18 and 19 illustrate a schematic diagram of a circuit for the operation of the pendulum-like nature of battery warning arm 12. Battery warning arm 12, 9 volt battery source 16, electromagnet 46, switch 48, permanent magnet 52, and pin 50 are shown in FIGS. 18 and 19.

PREFERRED EMBODIMENT—OPERATION

The battery warning arm 12 is designed to be activated when the detector's 10 battery 16 is missing, depleted, or is misaligned with battery contacts 116A and 116B. When activated, arm 12 swings down from detector 10 displaying luminous warning label 22. Label 22 clearly instructs occupants of a building that battery 16 should be replaced. Without reading any type of instructions, occupants, including children, would know to replace detectors 10 battery by simply observing instructional arm 12. Since label 22 is luminescent, arm 12 would be very noticeable in low light conditions.

Depleted battery 16 and spare battery 14 are exposed when arm 12 swings down. Thus, the warning arm also serves as a battery door. Not only are the occupants instructed of the battery problem when the arm is deployed, they are also visually confronted with battery 16 and spare battery 14. By exposing both batteries, occupants are further encouraged to take action since the batteries are readily accessible. Having spare battery 14 readily available without having to purchase a new battery is very convenient and thus further encourages battery replacement. Obviously when using the spare battery, the next time that battery needed to be replaced, a new battery will have to be purchased. Most 9 volt batteries are purchased in a double pack so when a user installs the new battery, he or she will be encouraged to use the second battery for the spare battery compartment. Thus the next time the battery needs to be replaced, the user has a spare one available.

Figure 10:
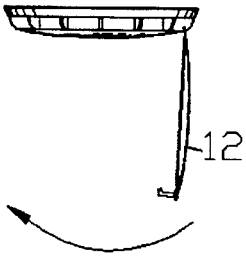

Referring to FIGS. 16 and 10, circuit 82 controls the action of warning arm 12. Latch 62 of solenoid assembly 44 has two positions. FIG. 16 illustrates the first position of latch 62 which allows warning arm 22 to be latched and returned to its stowed position. FIG. 17 illustrates the second position which does not allow warning arm 12 to be latched and thus cannot be stowed therefore it remains in its deployed position to warn tenants. Spring band 80 keeps latch 62 in either of the two positions mentioned.

The position of latch 62 is dependant on the voltage of battery 16 and is controlled by double pole single solenoid 84. Referring to FIG. 16, low voltage detection circuit 76 monitors the electrical energy of battery 16. Circuit 76 is well known in the art and can be obtained by referring to the Encyclopedia of Electronic Circuits. When battery 16 is at a critical voltage in which the occupant should replace the battery (typically 6 volts), low voltage detection circuit 76 activates relay 68B. By activating relay 68B, electrical energy is supplied to solenoid 84. The right pole of solenoid 84 is then energized and latch 62 is moved to the right as depicted in FIG. 17. This causes arm 12 to drop since warning arm latch 54 is not connected to latch 62 as shown in FIG. 17. Warning arm 12 can not be repositioned until latch 62 is returned to the left position.

When arm 12 is moved to the right, contact arm 78 closes contact switch 72B. This causes high voltage detection circuit 74 to be on a stand-by mode. Circuit 74 is well known in the art and can be obtained by referring to the Encyclopedia of Electronic Circuits. If a person replaces the depleted battery with a fresh one or correctly repositions the battery (if the battery was off its electrical contacts), then high voltage detection circuit 74 detects sufficient electrical energy to operate detector 10 (9 volts) and as a result activates relay 68A. By activating relay 68A, electrical energy is supplied to solenoid 84. The left pole of solenoid 84 is then energized and latch 62 is moved to the left as depicted in FIG. 16. When arm 12 is moved to the left, contact arm 78 closes contact switch 72A. This causes low voltage detection circuit 76 to be activated again.

With latch 62 moved in the left position, a person can reposition the arm into the stored position. Referring to FIG.

14, a persons hand 60 is shown repositioning warning arm 12 illustrating that the replacement of arm 12 to its stowed position is extremely simple.

FIG. 15 shows warning arm latch 54 rotated about pin assembly 118. Coil spring 64 is positioned about pin assembly 118 as to provide rotational force in the opposite direction (clockwise) of the rotation shown (counter clockwise). This allows warning arm latch 54 to be repositioned so that it is coupled with latch 62.

The pivoting nature of warning arm latch 54 and the design of latch 62 allows a person to pull the arm from its stowed position when latch 62 is in the left hand position. Thus, warning arm 12 can be manually swung down. This would be advantageous when a person replaces the detector's battery every year as recommended by manufacturers.

Referring to FIG. 16, in the event that a battery is removed before it is depleted or if the battery is misaligned with its electrical contacts, capacitor 70A will discharge through low voltage detection circuit 76. This discharge supplies electrical energy to relay 68B. With relay 68B closed, capacitor 70B is allowed to discharge. This discharge of electrical energy is supplied to the right pole of solenoid 84. With the right pole energized, arm 62 is moved to the right as depicted in FIG. 17. This causes arm 12 to drop thus warning of a missing or misaligned battery.

Figure 6:
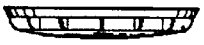
FIGS. 6–13 shows the sequence of events which occurs when the battery warning display arm is automatically activated.
Figure 7:
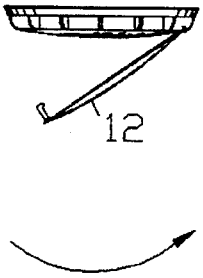
Figure 8:
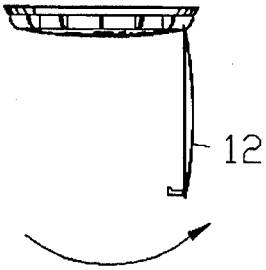
Figure 9:
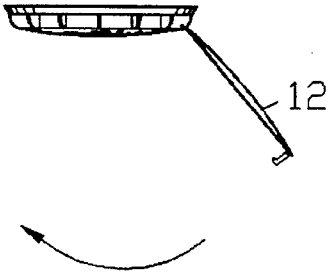
Figure 11:
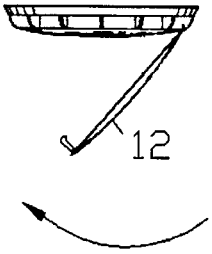
Figure 12:
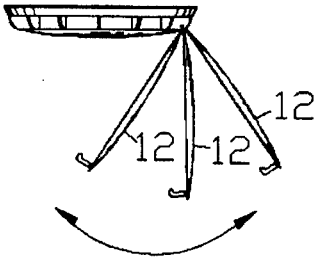
Figure 13:
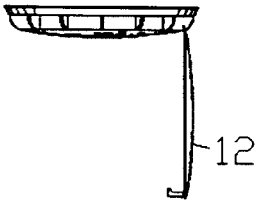

To further attract attention to warning arm 12, FIGS. 6–13 illustrates the pendulum-like motion of arm 12. In FIG. 6, arm 12 is at its original position indicating that the detector 10 has sufficient battery power to operate. In FIG. 7, arm 12 is activated and begins to swing and continues to swing in FIG. 8 until it reaches its furthest right position in FIG. 9. Having a sufficient amount of potential energy due to its height and gravity, arm 12 continues to swing to the left in FIG. 10. FIG. 11 indicates the furthest left position of arm 12. In FIG. 12, arm 12 is shown in the three primary positions during its pendulum like swing. In FIG. 13, arm 12 is shown at its resting position.

Warning arm 12 would only swing a few times back and forth and eventually come to a resting position due to gravity and frictional forces. To overcome the opposing forces, FIGS. 18 and 19 illustrate a possible configuration to allow warning arm 12 to swing continuously. This configuration is well known and is commonly used in pseudo perpetual motion machines. As arm 12 rotates about pin 50, the magnetic field from permanent magnet 52 opposes the magnetic field of electromagnet 46, thus producing a torque about pin 50. This torque overcomes the opposing forces and arm 12 is allowed to continue swinging. Electromagnet 46 is energized by battery 16. Switch 48 is activated by the sweeping magnetic field of permanent magnet 52. Switch 48 saves on battery power since electromagnet 46 is only activated when arm 12 swings past switch 48. Switch 48 is well known in the art and works on the principal of magnetic induction.

When the battery 16 is exhausted, it ceases to provide electrical energy to electromagnet 46 and arm 12 stops swinging in the pendulum like manner. However, arm 12 does continue to warn of the dangerous battery condition as shown in FIG. 13.

CONCLUSIONS, RAMIFICATIONS, AND SCOPE

Accordingly, it can be seen that the invention meets the objectives set forth above. Thus, the invention provides several innovations that address the specified problems with battery operated smoke detectors.

The warning arm design of this invention provides a complete yet simple solution to the many problems inherent to battery powered smoke detectors. If a battery is low, missing, completely dead or not aligned properly with the electrical contacts, the arm will warn the tenant and continue to warn until a fresh battery is present in the smoke detector. The warning arm provides a non- obtrusive friendly warning that is difficult to ignore, especially when the arm is swinging in a pendulum manner. The warning arm is extremely easy to operate and is not prone to tampering. The warning arm also serves as a battery door, thus making battery replacement very convenient, especially when using the spare battery compartment.

Thus, a complete solution to the problems associated with smoke detectors on the market today is made possible by the above innovations that are relatively simple and inexpensive to manufacture and are easy to use. As in the spirit of the first smoke detector, these innovations, when combined, have the potential to save many lives.

Although the description above contains many specificities, these should not be construed as limiting the scope of the invention but as merely providing illustrations of some of the presently preferred embodiments of this invention. Various other embodiments and ramifications are possible within its scope.

For example, the warning arm can also be used in conjunction with the chirping warning sound used on conventional smoke detectors by deploying the arm at a certain voltage and the chirping at a lower, more critical voltage.

The warning arm technology can also be applied to the newly popular carbon monoxide detectors. A carbon monoxide detector is equipped with a sensory pack that typically needs to be replaced every two years. The same chirping warning in smoke detectors is used when the sensory pack needs to be replaced. Unfortunately, the same problems stated above exist in carbon monoxide detectors. People will remove the sensory pack and forget to replace it and they will not be protected. This problem will be more prevalent in carbon monoxide detectors since sensory packs are not readily available like nine volt batteries. The warning arm can be adapted to notify the user that a sensory pack needs to be replaced. The warning arm would be ideal for both battery and electrically powered carbon monoxide detectors since the sensory pack modules are independent of electrical power and need to be replaced.

Thus the scope of the invention should be determined by the appended claims and their legal equivalents, rather than by the examples given.

What is claimed is:

1. A room-mountable battery operated detector device comprising:

a base plate to house detector's components, a cover that encloses and seals said detector's components in which said cover is attached to said base plate by fastener means, and an arm that is pivotally attached at one end to said cover by means of a pin connection in which said arm is normally stored in a position such that said arm is flush with said cover and in which said device comprises latching means for releasing said arm in response to the detection of a battery that is low or dead such that said arm is swung down in an angular motion from the normally flush stowed position to a position such as to create an angular distance between said cover and said arm and in which said arm provides means of warning of the dangerous battery condition.

2. The arm of claim 1 in which the force of gravity pulls said arm from said stowed position when said latching means releases said arm.

3. The arm of claim 1 such that said arm can not be repositioned to said stowed flush position until a sufficient voltage of said battery is present to operate said detector and in which said arm is easily repositioned by a person lightly pushing said arm at the end opposite to said pivot such that said latching means allows said arm to latch and remains latched until said battery is low, dead, missing, or not correctly aligned with its electrical contacts.

4. The arm of claim 1 in which after deployment of said arm from said stowed position said battery is exposed thus providing easy access to said battery and providing additional visual awareness of the battery condition whereby said arm serves as a battery warning apparatus and a battery door of said detector.

5. The arm of claim 1 wherein luminous brightly colored instructional graphics and words are provided in which said graphics and words are exposed upon the deployment of said arm from said stowed position.

6. The arm of claim 1 where upon deployment from the stowed position is put into a pendulum motion by means of the initial potential energy of the arm and kept in a swinging pendulum motion by means to overcome the opposing forces whereby the pendulum motion serves to attract further attention to a low battery condition.

7. The arm of claim 1 where upon deployment from the stowed position said arm is put into motion in a pendulum motion by means of the initial potential energy of the arm and kept in a swinging pendulum motion by an electromagnet connected to said plate and supplied electrical energy from said detectors battery which is controlled by means of a switch that is automatically activated upon said arms deployment and by a permanent magnet at the pivot end of said arm in which said arm is kept in a swinging pendulum motion by the opposing magnetic fields of said electromagnet and said permanent magnet until said battery expires at which the arm ceases to swing but remains in a deployed position to warn of the dead battery condition.

8. The detector of claim 1 wherein a spare battery compartment is provided in close proximity of said battery and in which is exposed when said arm is deployed.

9. The cover of claim 1 is constructed so that when attached to said base plate said detectors components are covered and said arm is allowed to rest in said flush stowed position.

10. The latching means of claim 1 allows said arm to be manually opened from the stowed position as to allow a person access to said battery for replacement.

* * * * *